US005787674A

United States Patent [19]

Nelson

[11] Patent Number: 5,787,674

[45] Date of Patent: Aug. 4, 1998

[54] METHOD OF INSTALLING LAMINATE COVERED STAIR NOSING

[75] Inventor: Thomas J. Nelson, Belton, Tex.

[73] Assignee: Premark RWP Holdings, Inc., Wilmington, Del.

[21] Appl. No.: 743,578

[22] Filed: Nov. 4, 1996

[51] Int. Cl.[6] ..... E04B 1/00

[52] U.S. Cl. ..... 52/741.2; 52/179

[58] Field of Search ..... 52/741.2, 716.1, 52/716.4, 716.6, 718.1, 717.03, 717.06, 179, 177

[56] References Cited

U.S. PATENT DOCUMENTS

| | | | |
|---|---|---|---|
| 2,827,675 | 3/1958 | Nelson | 52/179 |
| 3,308,598 | 3/1967 | Wilson | 52/716.4 |
| 4,455,797 | 6/1984 | Naka | 52/179 |
| 4,486,987 | 12/1984 | Naka | 52/716.1 X |

*Primary Examiner*—Creighton Smith
*Attorney, Agent, or Firm*—Oblon, Spivak, McClelland, Maier & Neustadt, P.C.

[57] ABSTRACT

Laminate covered stair nosing is affixed with sheet metal prongs, extending at right angles from the top surface of a sheet metal fastener, on the leading edge of a stair step. The sheet metal fastener has a U shaped flange extending beyond the leading edge of the tread. The laminate covered stair nosing has a planar top surface and a planar bottom surface. Prongs on the sheet metal fastener are forced into the planar bottom surface for affixing the stair nosing on the tread. The stair nosing has a U-shaped leading edge. The U-shaped leading edge extends beyond the leading edge of the tread. The U-shaped flange on the sheet metal fastener is interlocked with a channel in the U-shaped leading edge for supporting the stair nosing on the tread. A shoulder on the stair nosing abuts with the front surface of laminate flooring on the riser for retaining laminate flooring installed over a pad on the riser of the stair step.

3 Claims, 1 Drawing Sheet

METHOD OF INSTALLING LAMINATE COVERED STAIR NOSING

BACKGROUND OF THE INVENTION

1. Field of the Invention

This invention relates to the installation of laminate covered stair nosing.

2. Description of the Related Art

Commercially available laminate flooring generally includes a wear surface glued to a substrate. The wear surface generally is high-wear resistant decorative laminate. The substrate generally is fiber board or particle board. Each piece of laminate flooring generally has a groove along one end and one side suitable for joining with a tongue along one side or end of an adjacent piece of laminate flooring.

There is an need for stair nosing made by covering substrate such as fiberboard with laminate that matches the pattern of laminate flooring installed on stair steps. There is a need for a method of installing laminate covered stair nosing that does not blemish its decorative front surface.

SUMMARY OF THE INVENTION

A method has been developed for installing laminate covered stair nosing. In this method, laminate covered stair nosing is affixed with sheet metal prongs, extending at right angles from the top surface of a sheet metal fastener, on the leading edge of a stair step. A sheet metal fastener with thin wedge shaped prongs extending at right angles from its top planar surface is first affixed on the leading edge of the tread of a stair step. The sheet metal fastener is affixed on the front of the tread through a front flange extending at a right angle to the top surface of the fastener. The top surface of this sheet metal fastener is affixed in the top of the tread.

The sheet metal fastener has a U shaped flange extending beyond the leading edge of the tread. The top surface of the U-shaped flange is part of and on the same plane as the top surface of the sheet metal fastener. The bottom surface of the U-shaped flange is parallel to the top surface of this fastener. The front flange extends from and at a right angle to the bottom surface of the U-shaped flange.

The laminate covered stair nosing has a planar top surface and a planar bottom surface. Prongs on the sheet metal fastener are forced into the planar bottom surface for affixing the stair nosing on the tread. The planar bottom surface is parallel to the top planar surface. The stair nosing has a U-shaped leading edge and a planar back edge. The planar back edge of the stair nosing is in abutment with laminate flooring installed on the tread of a stair step. The planar back edge extends at right angles from the planar top and bottom surfaces. A groove extending along the planar back edge is interlocked with a tongue on laminate flooring.

The U-shaped leading edge extends beyond the leading edge of the tread. The top surface of the U-shaped leading edge is planar and is part of and on the same plane as the planar top surface of the stair nosing. The front of the U-shaped leading edge is rounded in the embodiment shown on the drawing. The bottom surface of the U-shaped leading edge is planar and parallel to the planar top surface of the stair nosing. The stair nosing has a shoulder extending from and at a right angle to the bottom surface of the U-shaped leading edge. The U-shaped leading edge also has a groove extending at a right angle to the shoulder. The upper surface of the groove is planar and on the same plane as the planar back surface of the stair nosing.

The U-shaped flange on the sheet metal fastener is interlocked with the channel in the U-shaped leading edge for supporting the stair nosing on the tread. The shoulder on the stair nosing abuts with the front surface of laminate flooring on the riser for retaining laminate flooring installed over a pad on the riser of the stair step.

The wedge shaped prongs on the sheet metal fastener are preferably at right angles to the leading edge of a stair step and the laminate on the stair nosing preferably covers medium density fiberboard.

BRIEF DESCRIPTION OF THE DRAWING

Shown is a cross section view of laminate covered stair nosing installed by the method of this invention on the leading edge of a stair step with prongs extending from the front surface of a sheet metal fastener.

DETAILED DESCRIPTION OF THE INVENTION

Figure 1:
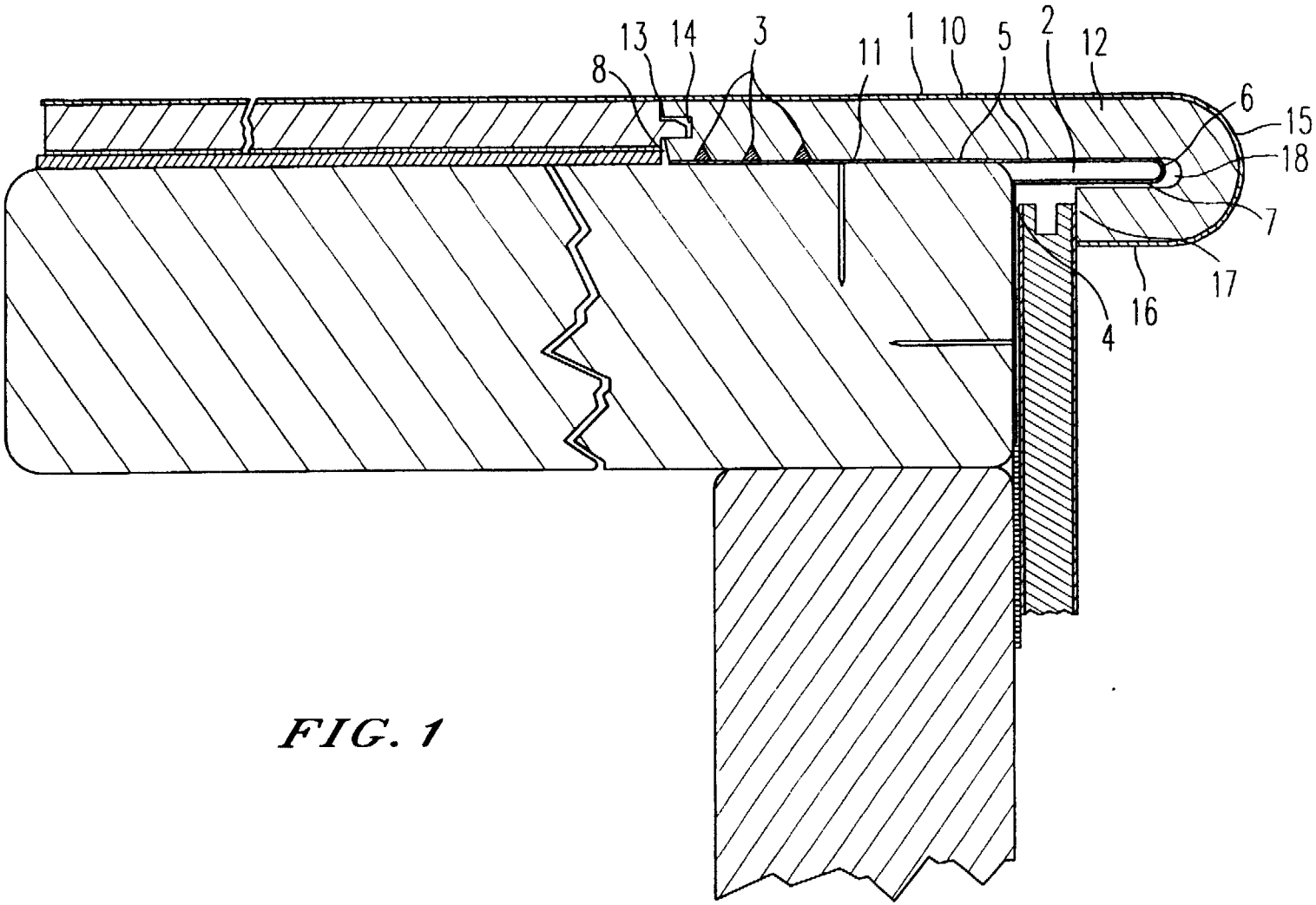

In the installation of stair nosing by the method of this invention, laminate covered stair nosing (1) is affixed with sheet metal prongs (3) extending from a sheet metal fastener (2) on the leading edge of a stair step. In this method a sheet metal fastener (2) with thin wedge shaped prongs (3) extending at right angles from its top planar surface (5) is first affixed, such as by nailing, on the leading edge of the tread of a stair step. This sheet metal fastener (2) has a front flange(4) extending at a right angle to the top surface of the fastener for affixing the front of this fastener on the front of the tread. The top surface (5) of this sheet metal fastener, with the wedge shaped prongs (3) extending therefrom, is affixed in the top of the tread.

The sheet metal fastener (2) has a U shaped flange (6) extending beyond the leading edge of the tread. The top surface (5) of the U-shaped flange (6) is part of and on the same plane as the top surface (5) of the sheet metal fastener (2). The bottom surface (7) of the U-shaped flange (6) is parallel to the top surface (5) of this fastener. The front flange (4) extends from and at a right angle to the bottom surface of the U-shaped flange.

The laminate covered stair nosing (1) has a planar top surface (10) and a planar bottom surface (11). Prongs (3) on the sheet metal fastener (1) are forced into the planar bottom surface (11) for affixing the stair nosing (1) on a tread of a stair step. The planar bottom surface (11) is parallel to the top planar surface (10). This stair nosing (1) also has a U-shaped leading edge (12) and a planar back edge (13). The planar back edge (13) of the stair nosing will abut with laminate flooring installed on a tread of a stair step. The planar back edge (13) extends from and at an acute angle to the planar top surface (10) and at an obtuse angle to the planar bottom surface (11). A groove (14) extends along the planar back edge (13) for interlocking with a tongue on laminate flooring.

The U-shaped leading edge (12) of the stair nosing (1) extends beyond the leading edge of a tread on a stair step on which it is installed. The top surface (10) of the U-shaped leading edge is planar and is part of and on the same plane as the planar top surface of the stair nosing. The front (15) of the U-shaped leading edge (12) is rounded. The bottom surface (16) of the U-shaped leading edge (12) is planar and parallel to the planar top surface (10) of the stair nosing. The stair nosing has a shoulder (17) extending from and at a right angle to the bottom surface (16) of the U-shaped leading edge (12). The U-shaped leading edge (12) also has a groove (18) extending from and at a right angle to the shoulder (17). The upper surface of the groove is planar and on the same plane as the planar back surface (11) of the stair nosing.

The U-shaped flange (6) on the sheet metal fastener (2) interlocks in the channel (18) in the U-shaped leading edge (12) for supporting the stair nosing on the tread of a stair step. The channel (18) in the U-shaped leading edge (12) of the stair nosing (1) is positioned over the U-shaped flange (6) on the sheet metal fastener (2) and the back edge (13) of the stair nosing is aligned with the back edge (8) of the sheet metal fastener (2). The stair nosing (1) is then forced onto the prongs (3) extending from the top surface (5) of the sheet metal fastener (2) for affixing the stair nosing on the leading edge of the tread of a stair step. The distance between the shoulder (17) on the stair nosing (1) and the front of a tread on a stair step is sufficient for retaining laminate flooring installed over a pad on the riser of the stair step.

The wedge shaped prongs (3) on the sheet metal fastener (2) are preferably die punched to be at right angles to the leading edge of a stair step. Thereby, laminate flooring on a stair step can expand due to atmospheric conditions and the wedge shaped prongs will slice through the substrate of the laminate flooring on its planar back surface while still affixing the laminate flooring on the tread of a stair step.

In a specific embodiment of a sheet metal fastener (2), wedge shaped prongs (3) extending at right angles from its top planar surface (5) is first affixed, such as by nailing, on the leading edge of the tread of a stair step. This sheet metal fastener (2) has a front flange (4) extending at a right angle to the top surface (5) of the fastener for affixing the front of this fastener on the front of the tread. The top surface (5) of this sheet metal fastener, with the wedge shaped prongs (3) extending therefrom, is affixed in the top of the tread.

The sheet metal fastener (2) has a U-shaped flange (6) extending beyond the leading edge of the tread. The top surface (5) of the U-shaped flange (6) is part of and on the same plane as the top surface (5) of the fastener (2. The bottom surface (7) of the U-shaped flange (6) is parallel to the top surface (5) of this fastener. The front flange (4) extends at a right angle to the bottom surface (7) of the U-shaped flange (6).

A specific embodiment of the sheet metal fastener (2) is made of 20 gauge galvanized steel. The top surface (5) of the fastener is 2.500 inches wide. The U-shaped flange (6) is 0.750 inches wide. The distance between the top (5) and bottom (7) surfaces of the U-shaped flange (6) is 0.125 inches. The front flange (4) is 1.250 inches wide. Three rows of die punched wedge shaped prongs (3) extend from the top surface (5) of the fastener (2). The center of the wedge shaped prongs (3) on the center row is 0.750 inches from the edge that is to be affixed on the top of the tread. The centers of the prongs on the other two rows are 0.250 inches from the center of the prongs on the center row. The prongs are spaced apart in each row by 0.375 inches. The width of the prongs at their base is 0.093 inches and their height is 0.093 inches. This embodiment of a sheet metal fastener is 32 inch long.

The embodiment of laminate covered stair nosing is laminate covered medium density fiberboard. This invention is not limited to the used of laminate covered medium density fiberboard, particle board or extruded plastic can be covered with laminate for making stair nosing. The selection of suitable materials, methods and equipment for making stair nosing is known to those skilled in the art of making laminate flooring.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty that reside in the present invention, including all features that would be treated as equivalents thereof by those skilled the art to which this invention pertains.

I claim:

1. A method of installing laminate covered stair nosing, comprising;

affixing a sheet metal fastener having thin wedge shaped sheet metal prongs extending at right angles from a top planar surface of the sheet metal fastener, on a leading edge of a tread of a stair step, wherein the sheet metal fastener is affixed on a front of the tread through a front flange extending at a right angle to the top planar surface of the sheet metal fastener, such that the top planar surface of the sheet metal fastener is affixed in a top portion of the tread;

wherein the sheet metal fastener has a U shaped flange, having a top surface and a bottom surface, extending beyond the leading edge of the tread, wherein the top surface of the U-shaped flange is part of and coplanar to the top planar surface of the sheet metal fastener, the bottom surface of the U-shaped flange is parallel to the top planar surface of the sheet metal fastener, and the front flange extends from and at a right angle to the bottom surface of the U-shaped flange;

affixing a laminate covered stair nosing with sheet metal prongs on a leading edge of a stair step, wherein the laminate covered stair nosing has a planar top surface and a planar bottom surface, prongs on the sheet metal fastener are forced into the planar bottom surface, the planar bottom surface is parallel to the planar top surface, wherein the stair nosing has a U-shaped leading edge and a planar back edge, wherein the planar back edge of the stair nosing is in abutment with laminate flooring installed on the tread of a stair step, the planar back edge extends at right angles from the planar top and bottom surfaces, and a groove extending along the planar back edge is interlocked with a tongue on the laminate flooring;

wherein the U-shaped leading edge extends beyond the leading edge of the tread, a top surface of the U-shaped leading edge is planar and is part of and coplanar with the planar top surface of the stair nosing, a bottom surface of the U-shaped leading edge is planar and parallel to the planar top surface of the stair nosing, wherein the stair nosing has a shoulder extending above and at a right angle to the bottom surface of the U-shaped leading edge, wherein the U-shaped leading edge also has a groove extending at a right angle to the shoulder, and an upper surface of the groove is planar and coplanar with the planar back edge of the stair nosing;

wherein the U-shaped flange on the sheet metal fastener is interlocked with a channel in the U-shaped leading edge, the shoulder on the stair nosing abuts with a front surface of laminate flooring on a riser of the stair step.

2. The method of installing laminate covered stair nosing of claim 1, wherein the wedge shaped prongs on the sheet metal fastener are at right angles to the leading edge of a stair step.

3. The method of installing laminate covered stair nosing of claim 1, wherein the laminate covered stair nosing comprises a decorative laminate over a medium density fiberboard substrate.

* * * * *